US006220590B1

(12) United States Patent
Bates et al.

(10) Patent No.: US 6,220,590 B1
(45) Date of Patent: Apr. 24, 2001

(54) HOPPER LOADER WITH A CONVEYER HAVING SLIPPAGE RESISTANCE

(75) Inventors: Jerry L. Bates, Redlands; Everardo Garza, Highland, both of CA (US)

(73) Assignee: Systems Technology, Inc., San Bernardino, CA (US)

( * ) Notice: Subject to any disclaimer, the term of this patent is extended or adjusted under 35 U.S.C. 154(b) by 0 days.

(21) Appl. No.: 09/074,348

(22) Filed: May 7, 1998

Related U.S. Application Data

(63) Continuation-in-part of application No. 08/954,867, filed on Oct. 21, 1997, now Pat. No. 6,017,029, and a continuation-in-part of application No. 08/954,868, filed on Oct. 21, 1997, now Pat. No. 6,017,028.

(51) Int. Cl.[7] ..... B65H 5/22

(52) U.S. Cl. ..... 271/3.01; 271/3.12; 271/3.13; 271/31.1; 271/150

(58) Field of Search ..... 271/3.01, 3.05, 271/3.08, 3.12, 149, 150, 151, 157; 198/699.1

(56) References Cited

U.S. PATENT DOCUMENTS

| | | | | |
|---|---|---|---|---|
| 874,982 | * | 12/1907 | Norton | 198/699.1 |
| 3,037,665 | | 6/1962 | Bradmiller et al. | 221/251 |
| 3,253,692 | * | 5/1966 | Ota | 198/699.1 |
| 3,422,947 | | 1/1969 | Kraft et al. | 198/16 |
| 3,741,413 | | 6/1973 | Friel | 214/41 |
| 3,858,490 | * | 1/1975 | Heisler | 271/150 X |
| 3,904,191 | | 9/1975 | Maier, Jr. et al. | 271/150 |
| 3,945,633 | | 3/1976 | Knopp | 271/3.1 |
| 3,945,635 | | 3/1976 | Marin | 271/202 |
| 4,008,890 | | 2/1977 | Pulda | 271/151 |
| 4,049,260 | | 9/1977 | Szymborski | 271/151 |
| 4,180,259 | | 12/1979 | Bewersdorf et al. | 271/200 |
| 4,373,710 | | 2/1983 | Hansen et al. | 271/55 |
| 4,396,112 | | 8/1983 | von Wietersheim et al. | 198/822 |
| 4,436,297 | | 3/1984 | Chandhoke | 271/3.1 |
| 4,451,967 | | 6/1984 | Stobb | 29/564.3 |
| 4,518,079 | | 5/1985 | Paelke | 198/864 |
| 4,565,285 | | 1/1986 | Koistinen | 198/819 |
| 4,588,180 | | 5/1986 | Ballestrazzi et al. | 271/5 |
| 4,861,014 | | 8/1989 | Martin | 271/198 |
| 4,934,682 | * | 6/1990 | Rece et al. | 271/150 X |
| 4,973,038 | | 11/1990 | Curley et al. | 271/146 |
| 5,026,038 | | 6/1991 | Weller et al. | 271/3.1 |
| 5,027,940 | | 1/1991 | Woodward | 198/500 |
| 5,088,711 | | 2/1992 | Newsome | 270/54 |
| 5,114,129 | | 5/1992 | Chang et al. | 270/1.1 |
| 5,116,303 | * | 5/1992 | Dietrich et al. | 271/150 X |
| 5,131,531 | | 7/1992 | Chambers | 198/860 |
| 5,238,239 | | 8/1993 | Lachapelle | 271/275 |
| 5,246,102 | | 9/1993 | Rappen et al. | 198/860.2 |
| 5,249,788 | * | 10/1993 | Helmstädter | 271/150 X |
| 5,282,613 | | 2/1994 | Standerfer et al. | 271/202 |
| 5,290,025 | | 3/1994 | Plent et al. | 271/181 |
| 5,354,045 | | 10/1994 | Boldrini et al. | 271/11 |

(List continued on next page.)

FOREIGN PATENT DOCUMENTS

| | | | |
|---|---|---|---|
| 2404627 | 9/1974 | (DE) . | |
| 2135978 | 9/1984 | (GB) | B65H/5/02 |

*Primary Examiner*—David H. Bollinger
(74) *Attorney, Agent, or Firm*—Roberts & Mercanti, LLP

(57) ABSTRACT

The invention pertains to a hopper loader apparatus for separating and forming an overlapping shingled stream of individual signatures of sheet materials from a vertically aligned, parallelepiped shaped stack of such signatures for subsequent handling operations. The hopper loader has a slippage resistant belt which engages a bottom edge of each signature and assists in preventing the signatures from slipping by keeping them upstanding. Preferably the slippage resistant belt has an array of projections extending upwardly from a belt surface which secures the signatures in place. This produces a smooth, regular, even signature stream. Individual signatures flow reliably, one-by-one off of the downward conveyor to another conveyor.

33 Claims, 9 Drawing Sheets

U.S. PATENT DOCUMENTS

| | | | |
|---|---|---|---|
| 5,360,102 | 11/1994 | Schoning | 198/831 |
| 5,374,050 | 12/1994 | Prim | 271/221 |
| 5,380,148 | 1/1995 | Bates et al. | 414/798.2 |
| 5,527,025 | 6/1996 | Schlough | 270/58.06 |
| 5,829,742 * | 11/1998 | Rabindran et al. | 271/150 |
| 6,017,028 * | 1/2000 | St. John et al. | 271/3.12 X |
| 6,017,029 * | 1/2000 | Bates et al. | 271/3.12 |

* cited by examiner

HOPPER LOADER WITH A CONVEYER HAVING SLIPPAGE RESISTANCE

CROSS REFERENCE TO RELATED APPLICATIONS

This application is a continuation in part of U.S. patent application Ser. No. 08/954,867 filed Oct. 21, 1997, now U.S. Pat. No. 6,017,029; and a continuation in part of U.S. patent application Ser. No. 08/954,868 filed Oct. 21, 1997, now U.S. Pat. No. 6,017,028.

BACKGROUND OF THE INVENTION

1. Field of the Invention

The invention pertains to a hopper loader apparatus for separating and forming an overlapping shingled stream of individual signatures of sheet materials from a vertically aligned, parallelepiped shaped stack of such signatures. The separated, individual signatures may then be subjected to subsequent handling operations.

2. Description of the Prior Art

In the graphic arts it is common that sheet materials such as newspapers, books, printed cartons and the like emerge from a printing operation in a serial stream of partially overlapping signatures in shingled form. Such a stream of signatures is typically collected on a conveyor and moved to a stacker for aligning. The stacker receives the sheets in a serial mode from the conveyor and forms a neatly aligned stack for removal and transportation. While large numbers signatures can be conveniently handled in stack form, some operations on the signatures can only be performed individually. It therefore becomes necessary to separate individual signatures from a stack for individual treatment. The present invention pertains to a vertical hopper loader for separating individual signatures, which are substantially vertically aligned on a folded edge, from a stack of signatures and then forming an overlapping shingled stream of individual signatures.

It has been a problem in the art to provide an efficient and effective means of separating a stack of signatures into its individual signatures for presentation to other equipment, such as a stitcher, a packer box on a binder line or the like. In the past, a stacked pile of printed signatures has been moved or pushed on a horizontal conveyor to an upwardly moving conveyor. Such an operation has many disadvantages since the stack does not reliably separate into evenly spaced overlapping individual signatures which inevitably leads to downstream signature jams and misfeeds requiring considerable operator attention. Complicated signature feeding equipment is known in the art. In this regard, U.S. Pat. No. 4,973,038 discloses a signature handling apparatus which uses a horizontal feed conveyor requiring a stack pusher. The signatures tend to slide down a second ramp conveyor and hence require a retainer wedge. U.S. Pat. No. 4,049,260 shows an apparatus for feeding sheets having a horizontal entry conveyor and a ramp conveyor with an abrupt transition to an exit conveyor. U.S. Pat. Nos. 5,282,613; 4,008,890 and 3,945,633 disclose other signature stream feeding apparatus.

The complicated nature of the construction and mode of operation of known on-edge signature supply assemblies leads to an irregular signature stream and increases the probability of a jam or other malfunction during operation of the signature supply assemblies. Slippage of on-edge signatures on conveyors is a significant problem with hopper loaders.

It has also been a problem in the art to reliably provide an efficient and effective means of separating a stack into its individual signatures and run reliably with a large range of signature sizes. The paper stock may range from heavyweight to lightweight and from a few pages to many pages per signature. This difference in paper weight and/or pagination has required the operator to perform many adjustments to make a machine ready for a production run. When multipage signatures having a bottom fold are moved on a folded edge, the forward motion of the conveyor, particularly a downwardly inclined conveyor tends to cause signatures to slide off conveyor chains. This results in paper jams, machine downtime and excess operator attention.

The present invention seeks to simplify hopper loader construction, reduce costs and avoid or reduce problems encountered in the prior art. Difficulties in operating vertical loaders arise in that a large quantity of signatures cannot be loaded in the loader without interfering with the feeding of signature at the supply station, and the loaders cannot handle very short and very long signatures without substantial changes in the feeding mechanism. Further, the signatures are subjected to a constant riffling, sliding and jostling action that results in damage to the folds on the signatures when they move between conveyor belts. The present invention provides a vertical loader which avoids or reduces problems encountered in the prior art. The invention provides an apparatus for separating individual signatures which are substantially vertically aligned on a folded edge from a stack of signatures and then feeding them to subsequent processing equipment.

According to the present invention a hopper loader which has a downwardly inclined entry conveyor is provided with a slippage resistant conveyor belt. Such a slippage resistant belt engages a bottom edge of an individual signature and assists in preventing the signature from slipping by not allowing the edge in contact with the belt to easily move away from its loading position on the belt. Preferably the slippage resistant belt has an array of projections extending upwardly from a belt surface which secures the signatures in place. This produces a smooth, regular, even signature stream. Individual signatures flow reliably, one-by-one off the downward conveyor to another conveyor.

According to one embodiment of the invention there is provided a hopper loader which has a downwardly inclined entry conveyor and an exit conveyor. The exit conveyor has an upwardly inclined planar ramp segment, an optional transition segment, and an exit segment. The transition segment has either a belt slide or a plurality of serially arranged rollers such that the arched transition segment has a radius of curvature sufficiently large such that a signature has a greater tendency to follow a path of the arched transition segment than to be propelled tangent to the upwardly inclined planar ramp segment.

In another embodiment of the invention, a hopper loader separates individual signatures which are substantially vertically aligned on a folded edge and moves them from a stack of signatures into a pocket from which they are fed by a feed mechanism to bindery equipment. The loader includes a downwardly inclined conveyor that moves a stack of signatures to an upwardly inclined conveyor which strips individual signatures from the stack and forms them into an overlapping shingled stream. The stream of signatures then moves to a product pocket including side walls, an indexing chain floor, and a stripper bar on the lower portion of each side wall. A product holdback deters selection of more than one signature at a time that is sent to the stitcher line. A vibrating jogger over the pocket used to even out the top of the product in the pocket one. Individual signatures flow reliably, one-by-one downwardly out of the pocket to bindery equipment. These and other features, advantages and improvements will be in part discussed and in part apparent to one skilled in the art upon a consideration of the detailed description of the preferred embodiment and the accompanying drawings.

SUMMARY OF THE INVENTION

The invention provides a hopper-loader which comprises:

a) a chassis;

b) a first continuous, downwardly inclined planar conveyor mounted on the chassis; said first conveyor being capable of moving a parallelepiped shaped stack of vertically aligned signatures to a second conveyor and depositing a separated, shingled stream of the signatures onto the second conveyor; said first conveyor comprising at least one continuous belt having a top surface and a bottom surface defined by a length and a width, said belt having slippage resistance means extending outwardly from the top surface of the belt which is capable of engaging bottom edges of the signatures and resisting the slippage of the bottom edges of the signature on the belt; and c) a continuous, second upwardly inclined conveyor mounted on the chassis and aligned with an end of the first conveyor; the second conveyor comprising a plurality of driven belts which travel over an upwardly inclined planar ramp segment.

The invention also provides a hopper-loader which comprises:

a) a chassis;

b) a first continuous, downwardly inclined planar conveyor mounted on the chassis; said first conveyor being capable of moving a parallelepiped shaped stack of vertically aligned signatures to a second conveyor and depositing a separated, shingled stream of the signatures onto the second conveyor; said first conveyor comprising at least one continuous belt having a top surface and a bottom surface defined by a length and a width, said belt having slippage resistance means extending outwardly from the top surface of the belt which is capable of engaging bottom edges of the signatures and resisting the slippage of the bottom edges of the signature on the belt; and c) a single, continuous, second conveyor mounted on the chassis and aligned with an end of the first conveyor; the second conveyor comprising a plurality of driven belts which travel over each of an upwardly inclined planar ramp segment, an arched transition segment, and a planar exit segment; the arched transition segment comprising either a belt slide or a plurality of serially arranged rollers.

The invention further provides a process for distributing a separated, shingled stream of the signatures from a parallelepiped shaped stack of vertically aligned signatures which comprises providing a hopper-loader as described above, placing a parallelepiped shaped stack of vertically aligned signatures onto the first conveyor; an edge of each signature being positioned within the slippage resistance means; and moving the parallelepiped shaped stack of vertically aligned signatures with the first conveyor and depositing a separated, shingled stream of the signatures onto the second conveyor.

The invention still provides a hopper-loader which comprises:

a) a first, downwardly inclined, planar conveyor which is capable of moving a parallelepiped shaped stack of substantially vertically aligned on edge signatures at a first speed to a second conveyor; said first conveyor comprising at least one continuous belt having a top surface and a bottom surface defined by a length and a width, said belt having slippage resistance means extending outwardly from the top surface of the belt which is capable of engaging bottom edges of the signatures and resisting the slippage of the bottom edges of the signature on the belt;

b) a second, upwardly inclined, planar conveyor which is capable of separating individual signatures from the stack on the first conveyor at an entry end of the second conveyor and moving the signatures in an overlapping shingled stream up the second conveyor at a second speed faster than the first speed, and forming the signatures into a parallelepiped shaped array of substantially vertically aligned on edge signatures in a signature pocket at an exit end of the second conveyor; wherein an angle is formed between the first, downwardly inclined, planar conveyor and the second, upwardly inclined, planar conveyor which is from about 125° to about 145°;

c) the signature pocket having spaced side walls positioned on each of two lateral sides of the rectangular array; and having a floor comprising a third intermittent indexing chain conveyor capable of sequentially moving the individual signatures in the parallelepiped shaped array of signatures away from the second conveyor.

The invention also provides a process for discharging individual signatures from a parallelepiped shaped stack of substantially vertically aligned on edge signatures which comprises:

a) moving a parallelepiped shaped stack of substantially vertically aligned on edge signatures along a first downwardly inclined planar conveyor at a first speed; said first conveyor comprising at least one continuous belt having a top surface and a bottom surface defined by a length and a width, said belt having slippage resistance means extending outwardly from the top surface of the belt which is capable of engaging bottom edges of the signatures and resisting the slippage of the bottom edges of the signature on the belt; an edge of each signature being positioned within the slippage resistance means;

b) separating individual signatures from the stack on the first conveyor and depositing the signatures in an overlapping shingled stream onto a second upwardly inclined planar conveyor moving at a second speed which is faster than the first speed, wherein an angle is formed between the first, downwardly inclined, planar conveyor and the second, upwardly inclined, planar conveyor which is from about 125° to about 145°, and moving the shingled stream of signatures with the second conveyor and forming them into a parallelepiped shaped array of substantially vertically aligned on edge signatures in a signature pocket; the signature pocket having spaced side walls positioned on each of two lateral sides of the parallelepiped shaped array and having a floor comprising a third indexing chain conveyor; and c) moving the individual signatures in the parallelepiped shaped array away from the second conveyor with the third conveyor.

DETAILED DESCRIPTION OF THE PREFERRED EMBODIMENT

Figure 1:
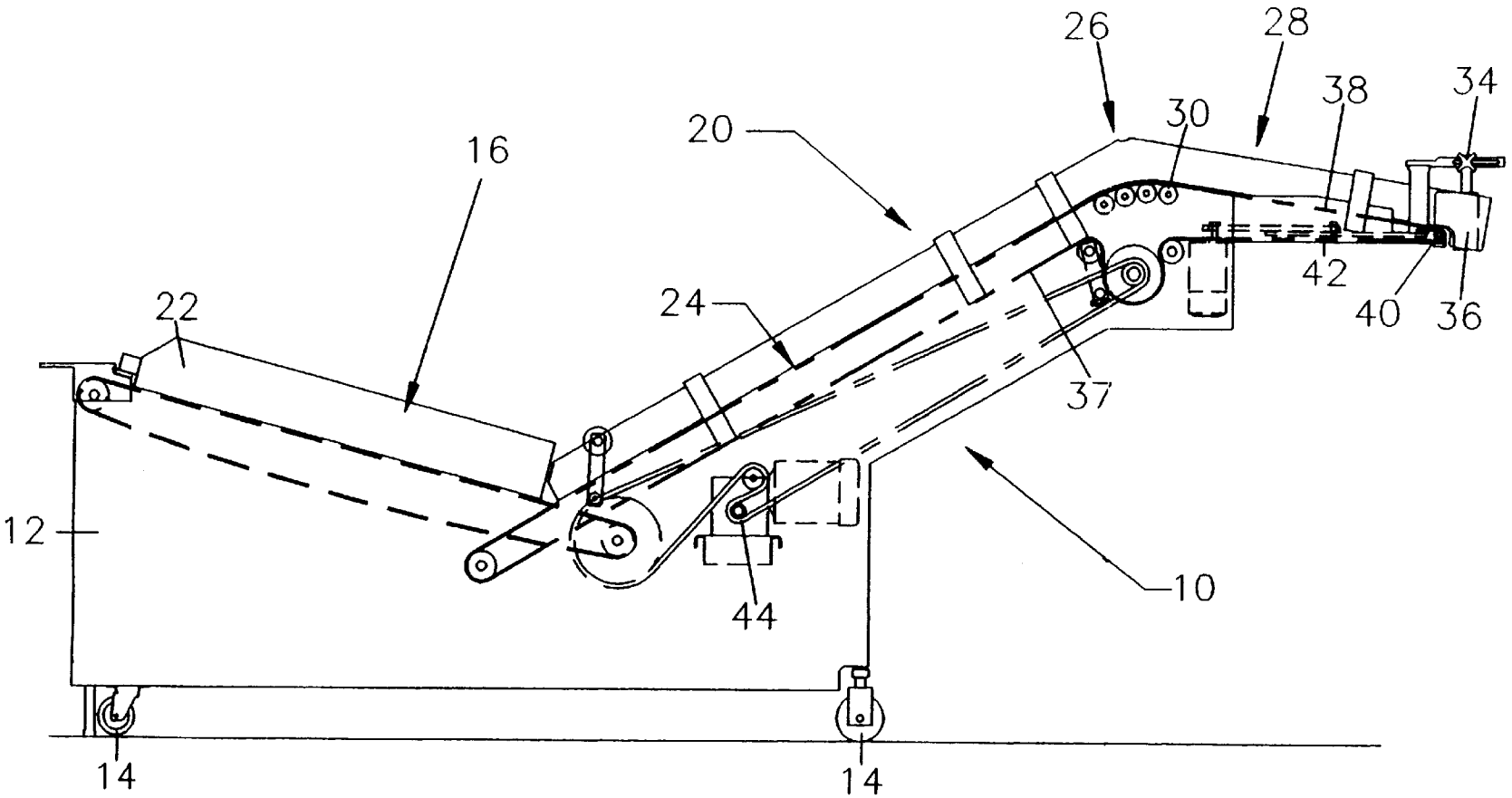
FIG. 1 shows a side view of one embodiment of the hopper loader according to the invention.
Figure 2:
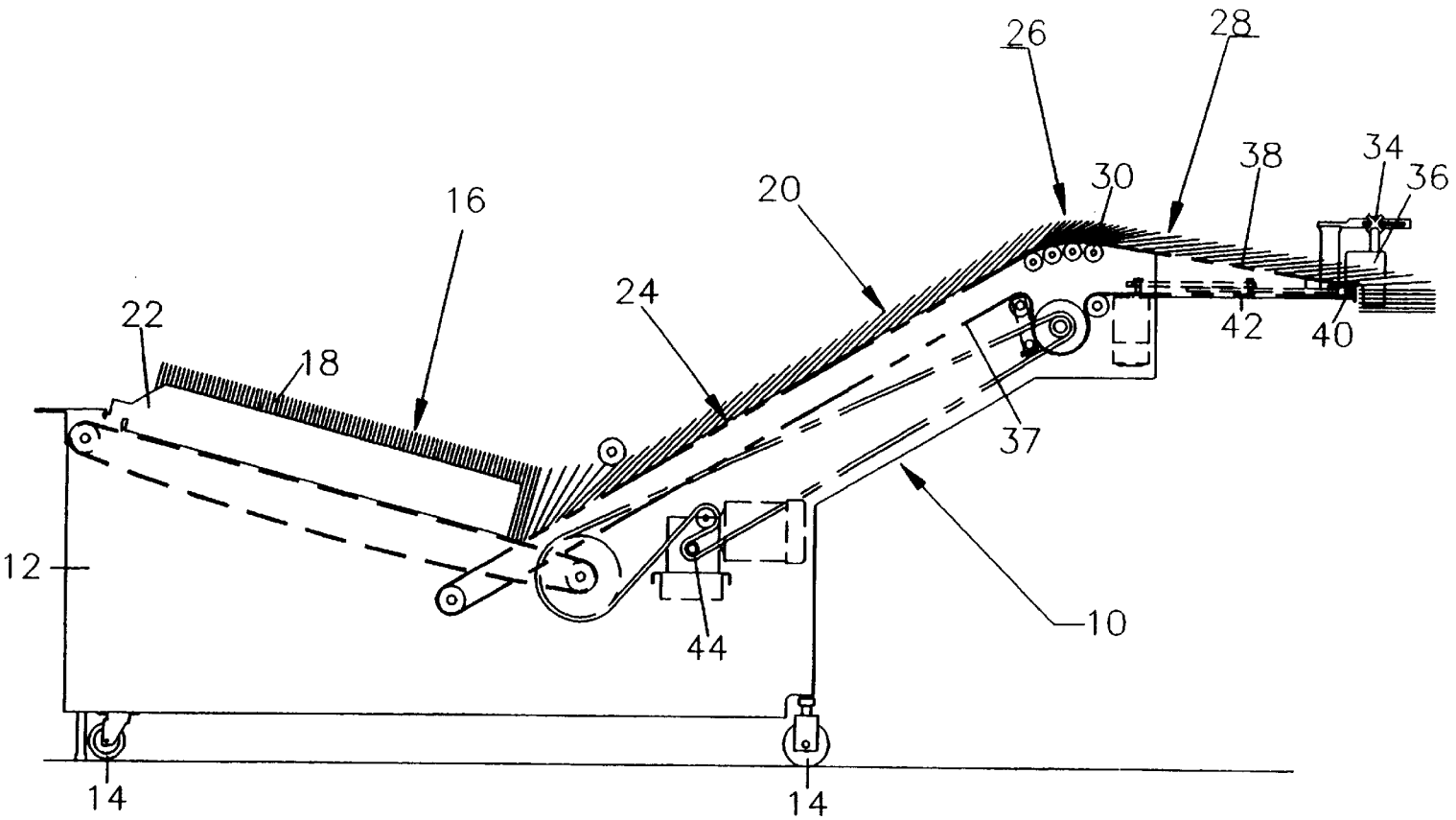
FIG. 2 shows a side view of one embodiment of a hopper loader according to the invention and further showing the movement path of signatures.

Referring to the drawings, FIGS. 1 and 2 show a hopper loader 10 according to the invention. It comprises a framework 12 which is movable by wheels 14. It has a first, downwardly inclined, planar conveyor 16 which preferably comprises a plurality of conveyor belts. In the preferred embodiment the belts are sturdy enough to move a relatively heavy stack of sheet signatures 18. As shown, the signatures are substantially vertically aligned and are in the form of a parallelepiped shaped stack. It is an important feature of the invention that the conveyor 16 be downwardly inclined. In the preferred embodiment, conveyor 16 has a downward decline measured from the horizontal of from about 10° to about 20°. This downward decline provides a gravity assist in the feeding of individual signatures from conveyor 16 to second upwardly inclined, planar conveyor section 20. In the preferred embodiment, the belts of the first conveyor are flat top chain belts plus at least one slippage resistant belt as shown in FIGS. 8–11. The second conveyor comprises a plurality of driven belts such that the belts of the first conveyor are aligned and interdigitated with the belts of the second conveyor.

The second conveyor 20 is capable of separating individual signatures from the stack on the first conveyor at an entry end of the second conveyor. Signatures fall over into an evenly overlapping shingled stream and travel up the second ramp conveyor as shown. In the preferred embodiment, the second conveyor has an upward incline measured from the horizontal of from about 25° to about 35°. An important feature of the invention is that an angle is formed between the first, downwardly inclined, planar conveyor and the second, upwardly inclined, planar conveyor which is from about 125° to about 145°. In addition, it is also important that the belts of the second conveyor belts travel at a speed which is faster than the belt speed of the first conveyor. In the preferred embodiment, the belt speed of the first conveyor ranges from about 1.1 feet/minute to about 7.1 feet per minute. In the preferred embodiment, the belt speed of the second conveyor ranges from about 5.9 feet/minute to about 38.5 feet per minute. Most preferably the speed ratio of the second conveyor to the first conveyor is from about 3:1 to about 9:1. This combination of downward sloping first conveyor, upward sloping second conveyor, included angle of from about 125° to about 145° and speed differential gives a smooth, even transition from a stack of signatures to a thick shingled stream of even overlapping individual signatures. The hopper loader configuration according to the invention, allows processing of a wide variety of sizes of signatures from thick multipage books to thin signatures having a very few pages. In the preferred embodiment, the signatures are supported down the first conveyor by a side guide 22.

As shown in FIG. 2, the stream of individual signatures travels up the incline of second conveyor in overlapping shingles fashion. The second conveyor comprises several integral, sequential segments, namely an upwardly inclined planar ramp segment 24, an arched transition segment 26, and a planar exit segment 28. The belts of the second conveyor move up ramp segment 24 and around the arched transition segment 26. The arched transition segment 26 comprises either a curved sheet metal slide over which the belts slide or a plurality of serially arranged rollers, such as 30. Preferably the arched transition segment comprises from about three to about five rollers, more preferably four rollers. The arched transition segment has a radius of curvature sufficiently large such that a signature moved by the second conveyor has a greater tendency to follow a path of the arched transition segment than to be propelled tangent to the upwardly inclined planar ramp segment. Preferably the arched transition segment has a radius of curvature of at least about 10 inches and more preferably from about 10 inches to about 15 inches.

Figure 3:
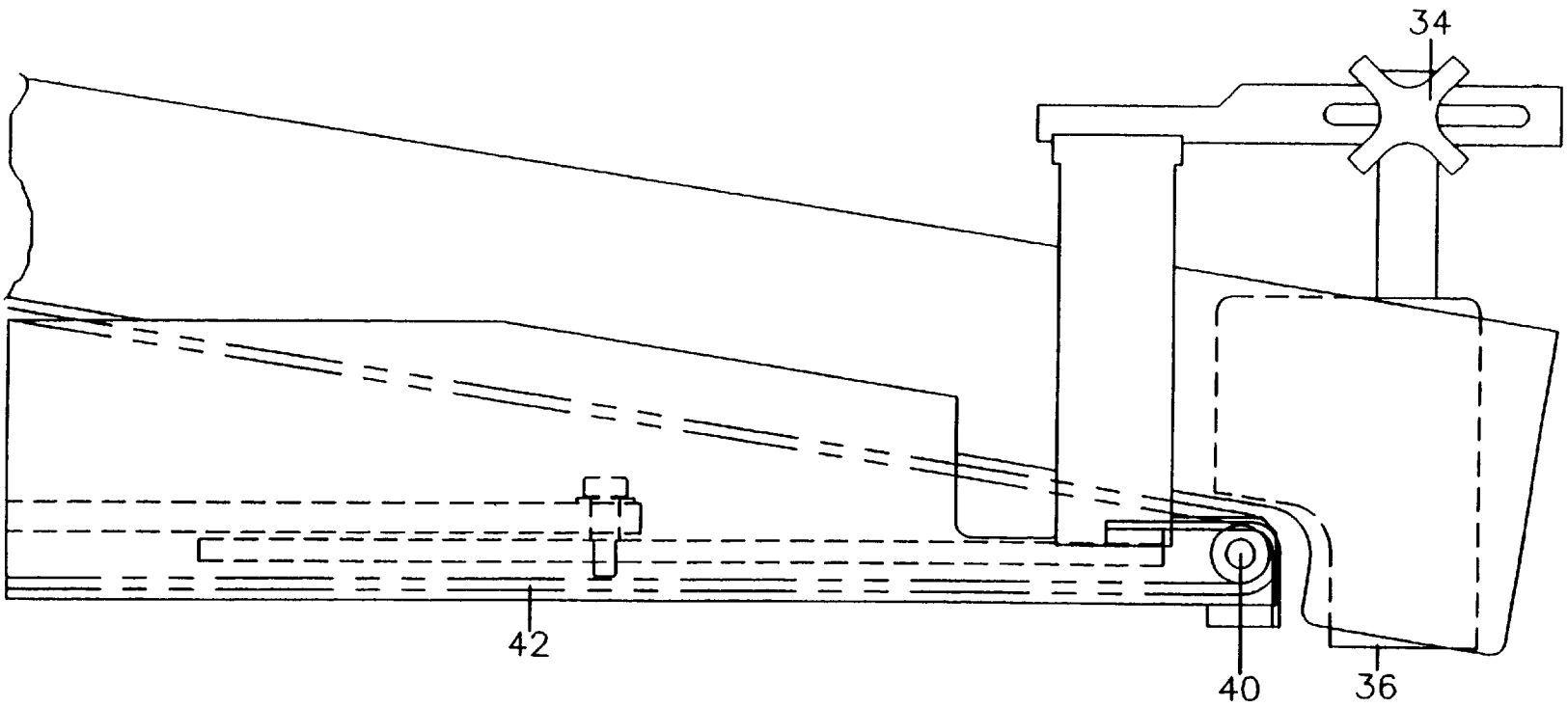
FIG. 3 shows a right side view of the planar exit segment of the second conveyor of one embodiment of a hopper loader according to the invention showing signature pushers and a signature jogger.
Figure 4:
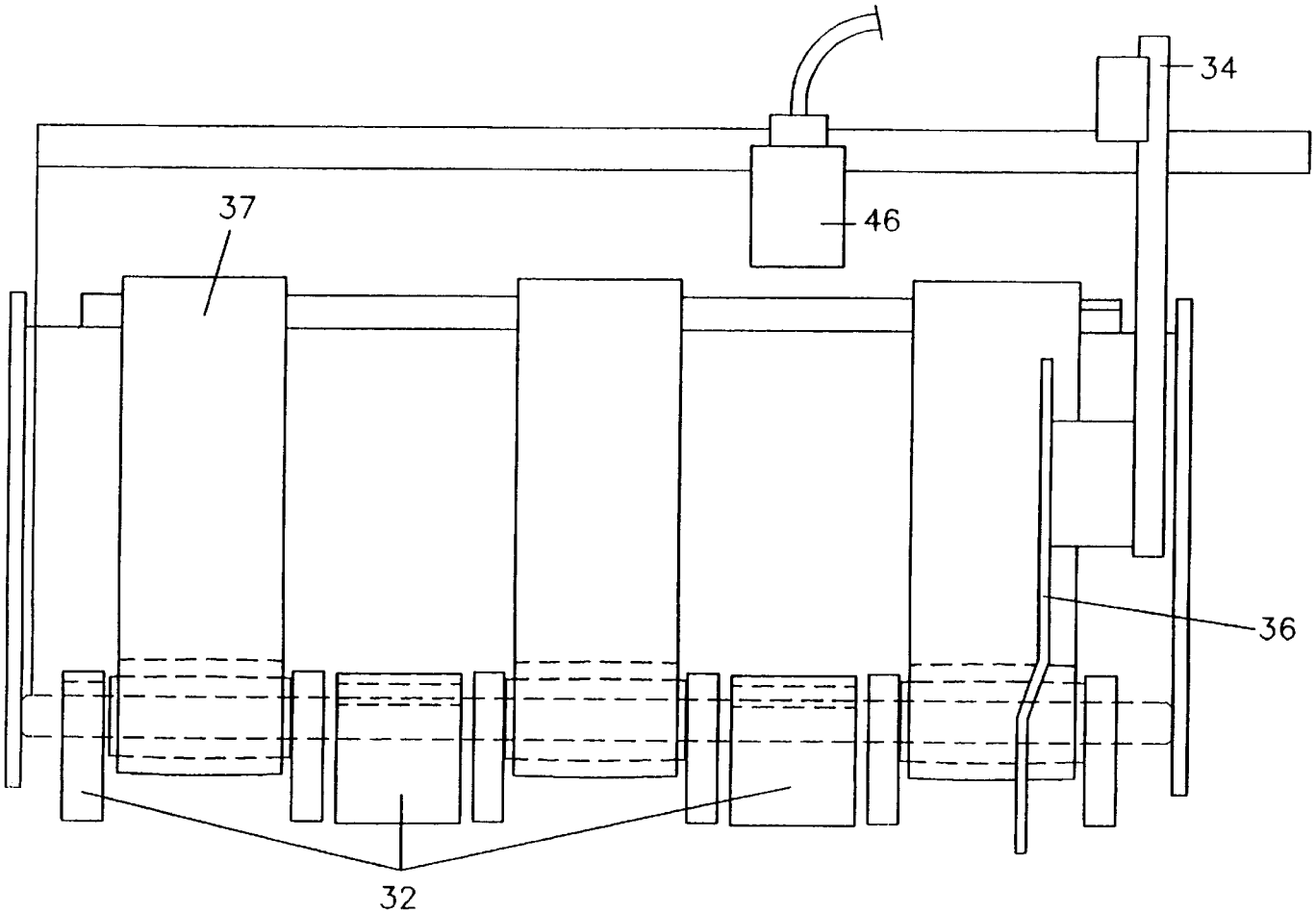
FIG. 4 shows a view of the front of the planar exit segment of the second conveyor of one embodiment of a hopper loader according to the invention showing signature pushers and a signature jogger.

The arched transition segment 26 progresses to planar exit segment 28. Preferably the planar exit segment of the second conveyor has a downward decline of from about 5° to about 20° measured from the horizontal. As shown in FIGS. 3 and 4 the planar exit segment of the second conveyor showing preferably has a plurality of reciprocating signature pushers such as L-shaped signature pushers 32 positioned between the belts 37, which push the signatures in a forward direction. Optionally, but preferably the planar exit segment of the second conveyor has a signature jogger 34, which aligns the signatures via jogger paddles 36 for exit from the second conveyor. The exit segment 28 preferably has a declining upper segment 38 terminating at a belt turnaround roller 40 which meets a substantially horizontal belt return segment 42. Preferably the turnaround roller has a diameter of about 3 inches or less. Preferably the angle between the upper segment and the return segment is in the range of about 10° or less. This gives a needle-nosed configuration which greatly assists in the precision placement of exiting signatures to subsequent processing equipment.

The movement of the first and second conveyors is accomplished by suitable drive means including motors, pulleys, belts and rollers shown generally at 44. It is understood that the provision of such suitable drive means is well within the ability of those skilled in the art. In the preferred embodiment, the drive of the first conveyor and the second conveyor are controlled by a sensor 46 such as a photoelectric cell which is responsive to the presence or absence of a signature at a position.

Figure 5:
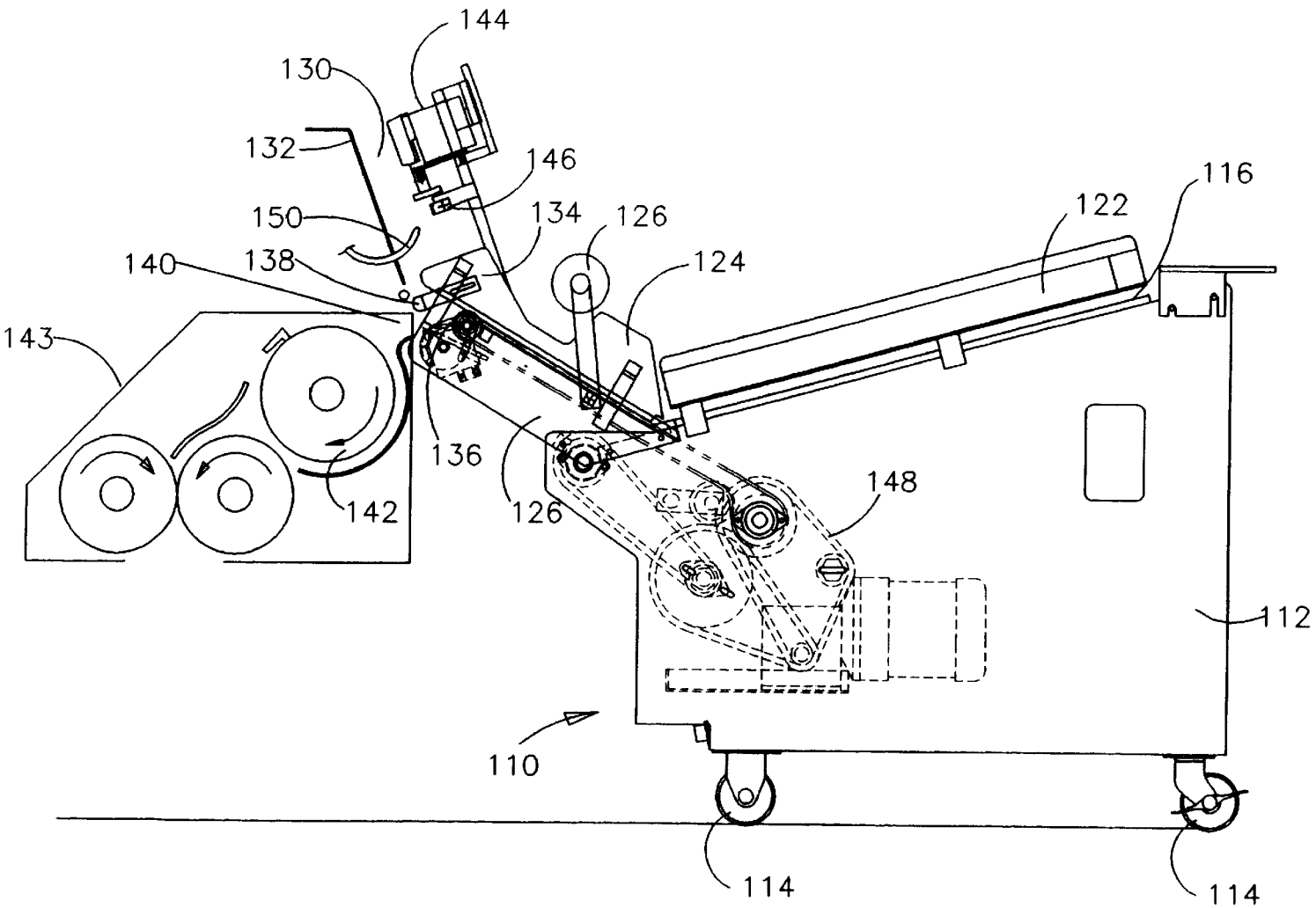
FIG. 5 shows a side view of another embodiment of a hopper loader according to the invention.
Figure 6:
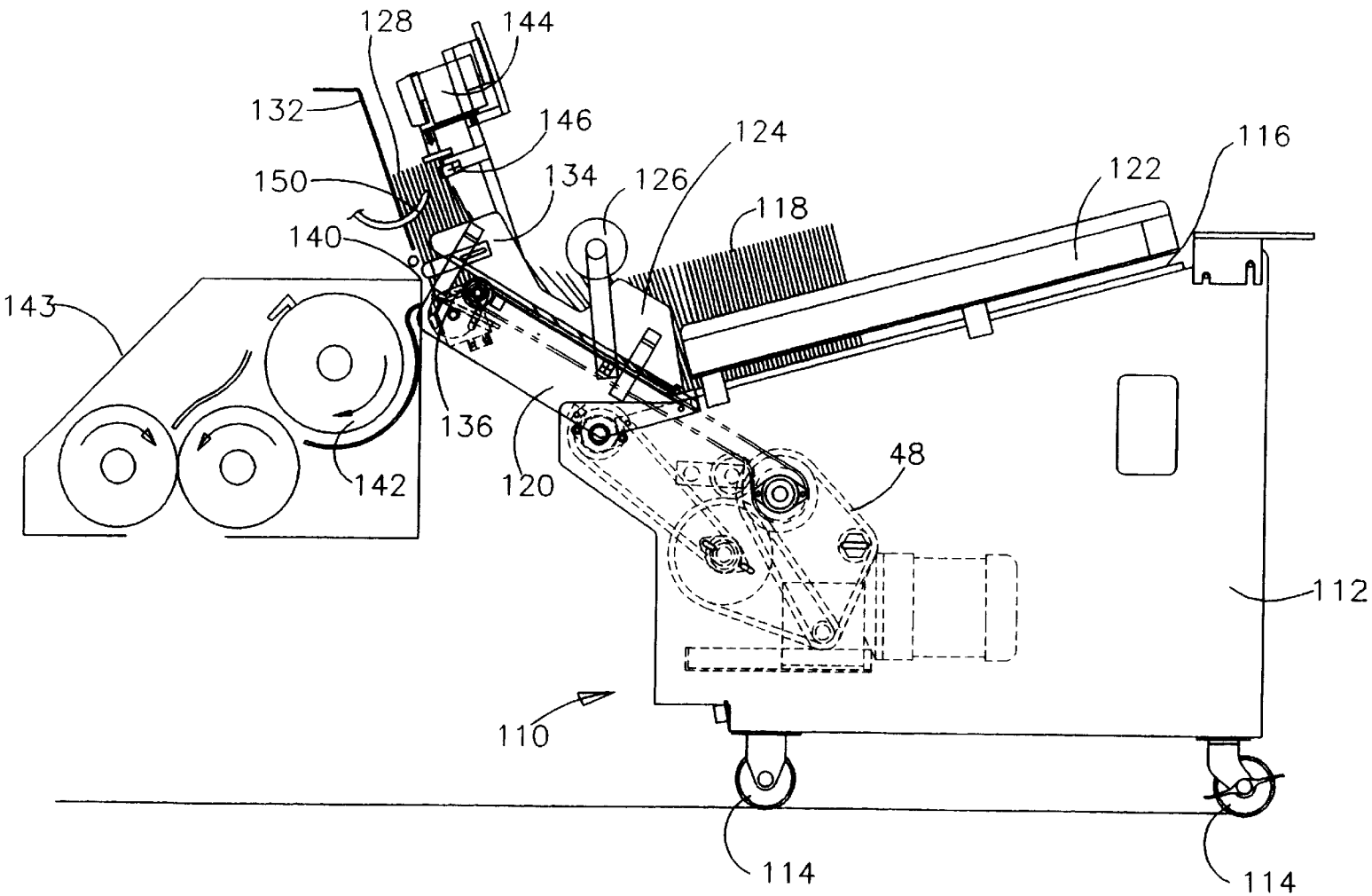
FIG. 6 shows a side view of another embodiment of a hopper loader according to the invention and further showing the movement path of signatures.

Referring to the drawings, FIGS. 5 and 6 show another embodiment of a hopper loader 110 according to the invention. It comprises a framework 112 which is movable by wheels 114. It has a first, downwardly inclined, planar conveyor 116 which preferably comprises a plurality of conveyor belts. In the preferred embodiment the belts are sturdy enough to move a relatively heavy stack of sheet signatures 118. As shown, the signatures are substantially vertically aligned and are in the form of a parallelepiped shaped stack. It is an important feature of the invention that the conveyor 116 be downwardly inclined. In the preferred embodiment, conveyor 116 has a downward decline measured from the horizontal of from about 10° to about 20°. This downward decline provides a gravity assist in the feeding of individual signatures from conveyor 116 to second upwardly inclined, planar conveyor section 120. In the preferred embodiment, the belts of the first conveyor are flat top chain belts and an additional slippage resistant belt as shown in FIGS. 8–11. The second conveyor comprises a plurality of driven belts such that the belts of the first conveyor are interdigitated with the belts of the second conveyor.

The second conveyor 120 is capable of separating individual signatures from the stack on the first conveyor at an entry end of the second conveyor. Signatures fall over into an evenly overlapping shingled stream and travel up the second ramp conveyor as shown. In the preferred embodiment, the second conveyor has an upward incline measured from the horizontal of from about 25° to about 35°. An important feature of the invention is that an angle is formed between the first, downwardly inclined, planar conveyor and the second, upwardly inclined, planar conveyor which is from about 125° to about 145°. In addition, it is also important that the belts of the second conveyor belts travel at a speed which is faster than the belt speed of the first conveyor. In the preferred embodiment, the belt speed of the first conveyor ranges from about 0.75 feet/minute to about 2 feet per minute. In the preferred embodiment, the belt speed of the second conveyor ranges from about 2.75 feet/minute to about 5.75 feet per minute. Most preferably the speed ratio of the second conveyor to the first conveyor is from about 2:1 to about 4:1. Although the first and second conveyors seem to operate relatively continuously, they preferably intermittently feed signatures to the pocket responsive to a signal from a sensor as described hereinafter. This combination of downward sloping first conveyor, upward sloping second conveyor, included angle of from about 125° to about 145° and speed differential gives a smooth, even transition from a stack of signatures to a thick shingled stream of even overlapping individual signatures. The hopper loader configuration according to the invention, allows processing of a wide variety of sizes of signatures from thick multipage books to thin signatures having a very few pages.

In the preferred embodiment, the signatures are supported down the first conveyor by a side guide 122 and the signatures are supported up the second conveyor by a side guide 124. In one embodiment of the invention, a stripper roller 126 is positioned above the second conveyor 120 to assist removing individual signatures from stack 118.

Figure 7:
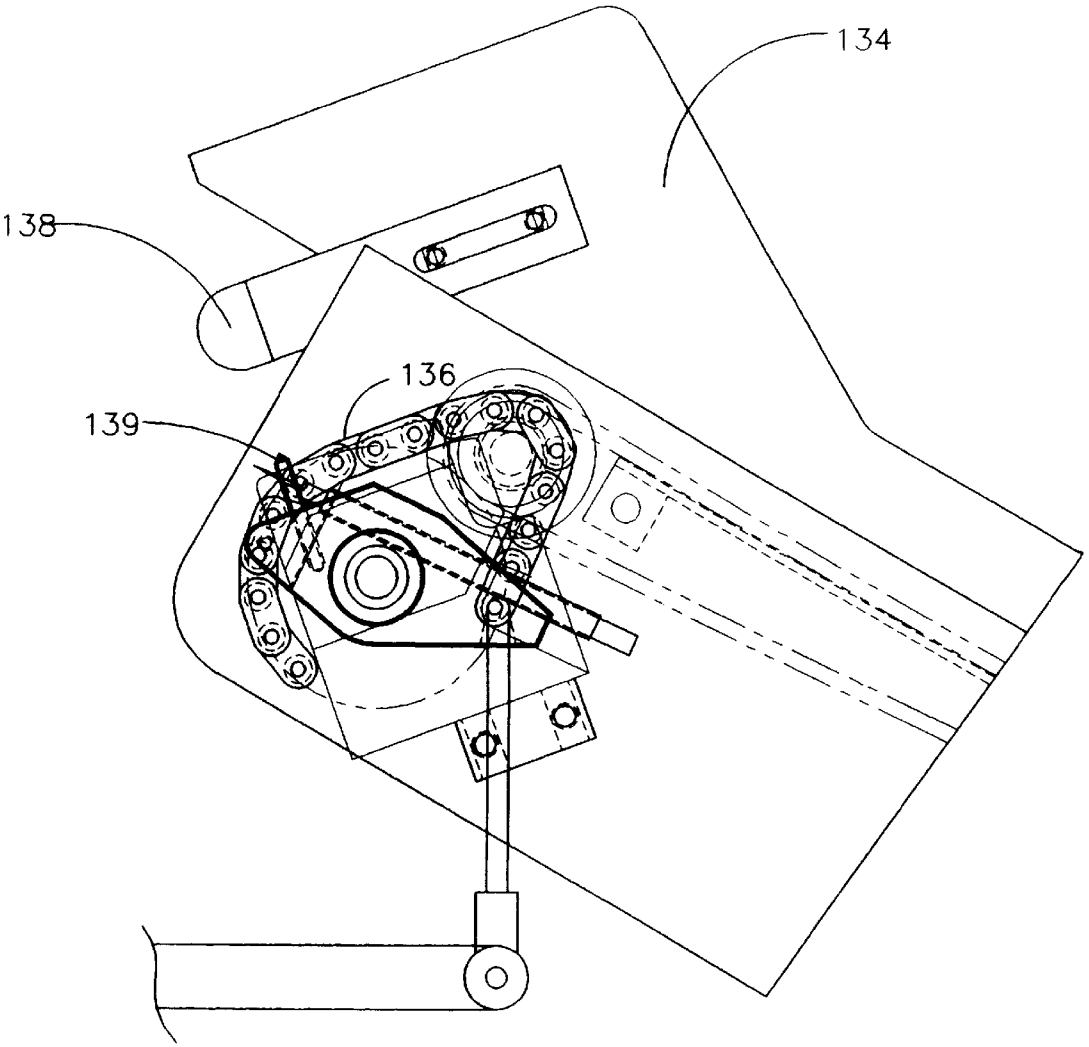
FIG. 7 shows a feed pawl arrangement useful the embodiment of the invention shown in FIGS. 5 and 6.

The shingled stream of individual signatures travels up the incline of second conveyor and they are formed into a parallelepiped shaped array of substantially vertically aligned on edge signatures 128 in a signature pocket 130 at an exit end of the second conveyor. The array is preferably from about 2 inches to about 4 inches thick. The formation of the array in the pocket having a relatively few vertical signatures results from the need to minimize the forward pressure on the forwardmost signature to be released from preceding signatures. The pocket is formed by spaced side walls 134 positioned on each of two lateral sides of the rectangular array. In one embodiment of the invention, the pocket comprises a front wall 132 in front of the side walls 134. In another embodiment of the invention, the front wall is part of subsequent bindery equipment. The pocket has a floor comprising a third conveyor 136 which is an intermittent indexing conveyor capable of sequentially moving the individual signatures away from the second conveyor. In the preferred embodiment, third conveyor is a generally eccentric loop which travels around a chain drive sprocket and a roller. The roller should be as small as possible to provide a small nip point transition between the second and third conveyors to provide a short release point for each signature. The loop has a short travel path and generally has a length in the pocket on the order of from about 2 to about 5 inches. The movement of the indexing chain conveyor is preferably controlled by a one way clutch or feed pawl 139 which is well known in the art and which is shown in FIG. 7. Extending forward from at least one and preferably each of the side walls 134 are optional but preferred, adjustable signature holdback means such as holdback bars 138. These holdback bars are required for some products but are optional for others. The space between the holdback bars is preferably less than the space between the side walls. These holdback bars serve to bow back the side edges of the signatures as they are moved forward by the indexing chain conveyor. The holdback bars keep the signatures behind the first signature in a bowed shape such that the signatures immediately following the first signature becomes stiffened by the bow thereby preventing rollout or other disruption of the second and following signatures as the first signature is pulled from the stack. This action assists in reliably separating each individual signature in the pocket for downward removal at exit point 140 by signature removal means 142 such as a rotary gripper, stripper pins or swing arm vacuum cups which attach to the spine of a signature and pull it away from the signature array. These removal means select one signature at a time and pull that signature down through the exit point to signature binding apparatus 143. Separation of the individual signatures can also be assisted by an air blower 150 which blows air into the signature array. In the preferred embodiment, the top edges of the array of signatures 128 are leveled by a high frequency vibrating jogger 144. By leveling the tops of the signatures in the array, the signature bottoms are also evened with respect to the signature removal means 142. The well jogged bottoms of the signatures in the array result in more reliable, continuous feeding of individual signatures regardless of paper weight, caliper and other variables. The presence of the top jogger dramatically reduces the number of misfeeds.

Preferably, the hopper loader has a signature sensor 146 such as a photoeye, at the signature pocket, which controls the moving of the first conveyor and the second conveyor responsive to the presence or absence of a signature at the last position in the pocket and keeps the pocket filled with signatures. The photoeye is preferably set to examine the side of the last expected signature in the pocket. Thus when the last signature has been moved forward by the indexing chain conveyor, the photoeye senses the absence of a signature at that position and issues a signal to drives for the first and second conveyors to move the next signature forward. Thus signature advance is ultimately controlled by the independent action of the indexing chain conveyor in positioning and removing signatures. The first and second conveyors intermittently stop and start and hence replenish signatures into the pocket as required. The movement of the first and second conveyors is accomplished by suitable drive means including motors, pulleys, belts and rollers shown generally at 148. Preferably the movement of the third conveyor is accomplished by suitable drive means including the feed pawl, a ratchet assembly, motors, pulleys, belts and rollers which are independent of the drive means 148 for the first and second conveyors.

Figure 8:
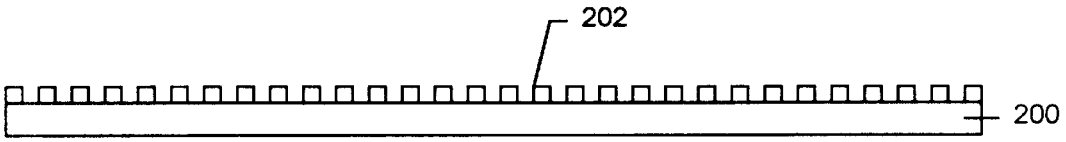
FIG. 8 shows a schematic side view of a slippage resistant belt wherein slippage resistance means is in the form of an array of upright, spaced projections extending outwardly perpendicularly from the top surface of the belt.
Figure 9:
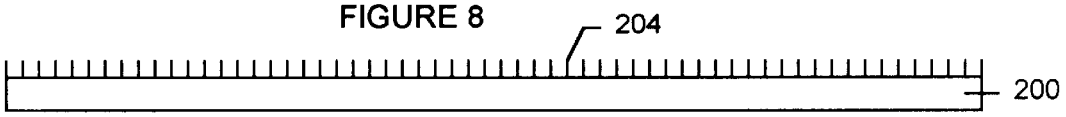
FIG. 9 shows a schematic side view of a slippage resistant belt wherein slippage resistance means is in the form of a fibrous material, a brush, velour fabric or a velcro fabric or burr material.
Figure 10:
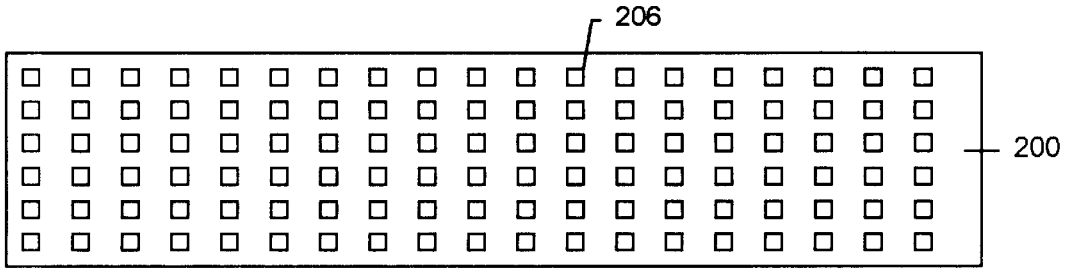
FIG. 10 shows a schematic top view of a slippage resistant belt wherein slippage resistance means is in the form of an array of upright, spaced teeth projecting outwardly from the top belt surface.
Figure 11:
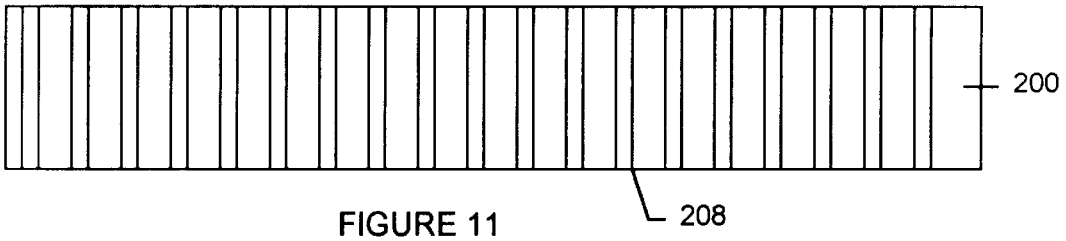
FIG. 11 shows a schematic top view of a slippage resistant belt wherein the slippage resistance means is in the form of an array of upright, spaced ridges which project outwardly from the top belt surface.
Figure 12:
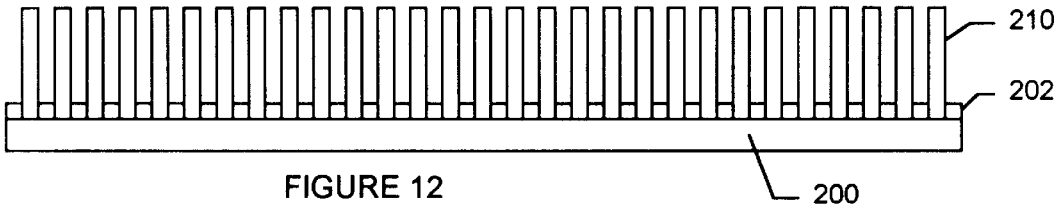
FIG. 12 shows a schematic representation of vertically aligned signatures which is positioned within the slippage resistance means of a belt.
Figure 13:
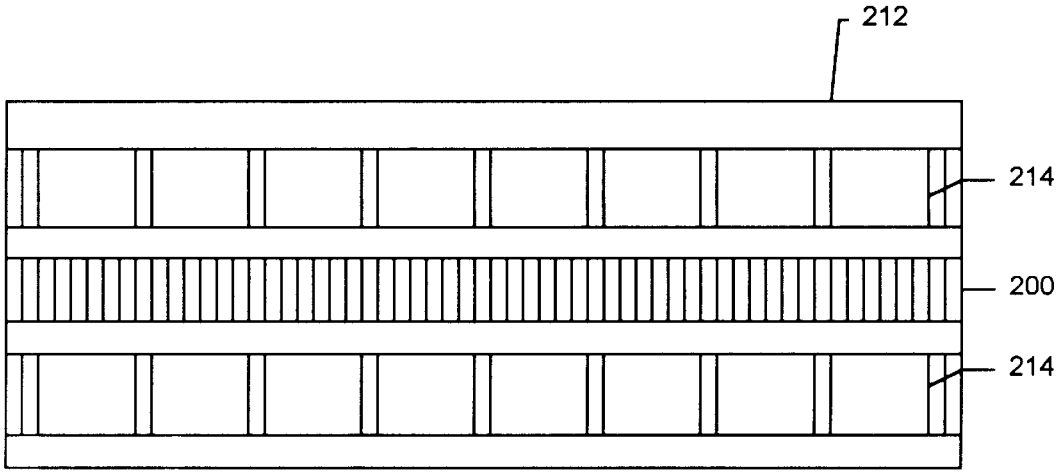
FIG. 13 is a schematic representation of a conveyor having an endless belt provided with slippage resistance means and also having flat top chain belts.

FIGS. 8–11 show side and top views of a variety of continuous belts which can be used as part of the first conveyors according to the invention. They are shownto have various types of slippage resistance means extending outwardly from the top surface of the belt. FIG. 8 shows a side view of one type of slippage resistant belt wherein an endless belt 200 is provided with slippage resistance means extending outwardly from the top surface of the belt which is capable of engaging bottom edges of the signatures and resisting the slippage of the bottom edges of the signature on the belt. In FIG. 8, the slippage resistance means 202 can be any suitable array of upright, spaced projections extending outwardly perpendicularly from the top surface of the belt. As shown in FIG. 9, the slippage resistance means can comprise a fibrous material such as carpeting, a brush, velour fabric or a velcro fabric or burr material 204. As shown in FIG. 10, The projections can be an array of upright, spaced teeth 206 projecting outwardly from the top surface. Although they are depicted as evenly spaced, the projections can also be randomly spaced apart. The teeth can be arranged in a plurality of parallel rows across the width and perpendicular to the length of the top surface. As shown in FIG. 11, the projections comprise an array of upright, spaced ridges 208 which project outwardly from the top surface. The ridges can also be arranged in several parallel rows across the width and perpendicular to the length of the top surface. In the preferred embodiment, the belt 202 and projections can comprise a rigid material or a resilient elastomeric material which project from the top surface of the belt a distance of from about 1/32 inch to about 3/16 inch. These slippage resistant belts can either be a single drive belt for the first conveyor, or there can be several slippage resistant belts used by the first conveyor or there can be different drive belts such as flat top chain belts in addition to at least one slippage resistant belt for the first conveyor. FIG. 12 shows a schematic representation of vertically aligned signatures 210 each having an edge which sinks down and is positioned within the slippage resistance means 202 of the belt 200. The slippage resistance means 202 catches a bottom edge of the folded signature bottom and pushes the signature forward. Although the signatures are depicted as not touching each other, in the usual case, the signatures do not stand upright, but rather are bent over and overlap one another in shingled form. FIG. 13 is a schematic representation of a conveyor such as downwardly inclined conveyor 16 from FIG. 1 or conveyor 116 from FIG. 5. The conveyor 116 has at least one endless belt 200 is provided with slippage resistance means, but may also have other belts 214 which may be, for example, flat top chain belts.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A hopper-loader which comprises:

a) a first, downwardly inclined, planar conveyor which is capable of moving a parallelepiped shaped stack of substantially vertically aligned on edge signatures at a first speed to a second conveyor; said first conveyor comprising at least one continuous belt having a top surface and a bottom surface defined by a length and a width, b) a second, upwardly inclined, planar conveyor which is capable of separating individual signatures from the stack on the first conveyor at an entry end of the second conveyor and moving the signatures in an overlapping shingled stream up the second conveyor at a second speed faster than the first speed, and forming the signatures into a parallelepiped shaped array of substantially vertically aligned on edge signatures in a signature pocket at an exit end of the second conveyor; wherein an angle is formed between the first, downwardly inclined, planar conveyor and the second, upwardly inclined, planar conveyor which is from about 125° to about 145°;

c) the signature pocket having spaced side walls positioned on each of two lateral sides of the rectangular array; and having a floor comprising a third intermittent indexing chain conveyor capable of sequentially moving the individual signatures in the parallelepiped shaped array of signatures away from the second conveyor.

2. The hopper loader of claim 1 wherein said slippage resistance means comprises an array of upright, spaced projections extending outwardly perpendicularly from the top surface of the belt.

3. The hopper loader of claim 2 wherein said projections comprise an array of upright, spaced ridges projecting outwardly from the top surface, said ridges being arranged in a plurality of parallel rows across the width and perpendicular to the length of the top surface.

4. The hopper loader of claim 3 wherein said spaced ridges comprise an elastomeric material.

5. The hopper loader of claim 3 wherein the ridges project from the top surface a distance of from about 1/32 inch to about 3/16 inch.

6. The hopper loader of claim 2 wherein said projections comprises a plurality of spaced teeth.

7. The hopper loader of claim 2 wherein said projections comprise an array of upright, spaced teeth projecting outwardly from the top surface, said teeth being arranged in a plurality of parallel rows across the width and perpendicular to the length of the top surface.

8. The hopper loader of claim 7 wherein said teeth comprise an elastomeric material.

9. The hopper loader of claim 7 wherein said teeth project from the top surface a distance of from about 1/32 inch to about 3/16 inch.

10. The hopper loader of claim 1 wherein said slippage resistance means comprises a fibrous material, a brush, velour fabric, or hook ad loop fastener material.

11. A process for discharging individual signatures from a parallelepiped shaped stack of substantially vertically aligned on edge signatures which comprises:

a) moving a parallelepiped shaped stack of substantially vertically aligned on edge signatures along a first downwardly inclined planar conveyor at a first speed; said first conveyor comprising at least one continuous belt having a top surface and a bottom surface defined by a length and a width, said belt having slippage resistance means extending outwardly from the top surface of the belt which is capable of engaging bottom edges of the signatures and resisting the slippage of the bottom edges of the signature on the belt; an edge of each signature being positioned within the slippage resistance means;

b) separating individual signatures from the stack on the first conveyor and depositing the signatures in an overlapping shingled stream onto a second upwardly inclined planar conveyor moving at a second speed which is faster than the first speed, wherein an angle is formed between the first, downwardly inclined, planar conveyor and the second, upwardly inclined, planar conveyor which is from about 125° to about 145°, and moving the shingled stream of signatures with the second conveyor and forming them into a parallelepiped shaped array of substantially vertically aligned on edge signatures in a signature pocket; the signature pocket having spaced side walls positioned on each of two lateral sides of the parallelepiped shaped array and having a floor comprising a third indexing chain conveyor; and c) moving the individual signatures in the parallelepiped shaped array away from the second conveyor with the third conveyor.

12. A hopper-loader which comprises:

a) a chassis;

b) a first continuous, downwardly inclined planar conveyor mounted on the chassis; said first conveyor being capable of moving a parallelepiped shaped stack of vertically aligned signatures to a second conveyor and depositing a separated, shingled stream of the signatures onto the second conveyor; said first conveyor comprising at least one continuous belt having a top surface and a bottom surface defined by a length and a width, said belt having slippage resistance means extending outwardly from the top surface of the belt which is capable of engaging bottom edges of the signatures and resisting the slippage of the bottom edges of the signature on the belt; and c) a continuous, second upwardly inclined conveyor mounted on the chassis and aligned with an end of the first conveyor; the second conveyor comprising a plurality of driven belts which travel over an upwardly inclined planar ramp segment.

13. The hopper loader of claim 12 wherein said slippage resistance means comprises an array of upright, spaced projections extending outwardly perpendicularly from the top surface of the belt.

14. The hopper loader of claim 13 wherein said projections comprise an array of upright, spaced ridges projecting outwardly from the top surface, said ridges being arranged in a plurality of parallel rows across the width and perpendicular to the length of the top surface.

15. The hopper loader of claim 14 wherein said spaced ridges comprise an elastomeric material.

16. The hopper loader of claim 14 wherein the ridges project from the top surface a distance of from about 1/32 inch to about 3/16 inch.

17. The hopper loader of claim 13 wherein said projections comprises a plurality of spaced teeth.

18. The hopper loader of claim 13 wherein said projections comprise an array of upright, spaced teeth projecting outwardly from the top surface, said teeth being arranged in a plurality of parallel rows across the width and perpendicular to the length of the top surface.

19. The hopper loader of claim 18 wherein said teeth comprise an elastomeric material.

20. The hopper loader of claim 18 wherein said teeth project from the top surface a distance of from about 1/32 inch to about 3/16 inch.

21. The hopper loader of claim 12 wherein said slippage resistance means comprises a fibrous material, a brush, velour fabric, or hook and loop fastener material.

22. A process for distributing a separated, shingled stream of the signatures from a parallelepiped shaped stack of vertically aligned signatures which comprises i) providing a hopper-loader which comprises:

a) a chassis;

b) a first continuous, downwardly inclined planar conveyor mounted on the chassis; said first conveyor being capable of moving a parallelepiped shaped stack of vertically aligned signatures to a second conveyor and depositing a separated, shingled stream of the signatures onto the second conveyor; said first conveyor comprising at least one continuous belt having a top surface and a bottom surface defined by a length and a width, said belt having slippage resistance means extending outwardly from the top surface of the belt which is capable of engaging bottom edges of the signatures and resisting the slippage of the bottom edges of the signature on the belt; and c) a continuous, second upwardly inclined conveyor mounted on the chassis and aligned with an end of the first conveyor; the second conveyor comprising a plurality of driven belts which travel over each of an upwardly inclined planar ramp segment; and ii) placing a parallelepiped shaped stack of vertically aligned signatures onto the first conveyor; an edge of each signature being positioned within the slippage resistance means;

iii) moving the parallelepiped shaped stack of vertically aligned signatures with the first conveyor and depositing a separated, shingled stream of the signatures onto the second conveyor.

23. A hopper-loader which comprises:

a) a chassis;

b) a first continuous, downwardly inclined planar conveyor mounted on the chassis; said first conveyor being capable of moving a parallelepiped shaped stack of vertically aligned signatures to a second conveyor and depositing a separated, shingled stream of the signatures onto the second conveyor; said first conveyor comprising at least one continuous belt having a top surface and a bottom surface defined by a length and a width, said belt having slippage resistance means extending outwardly from the top surface of the belt which is capable of engaging bottom edges of the signatures and resisting the slippage of the bottom edges of the signature on the belt; and c) a single, continuous, second conveyor mounted on the chassis and aligned with an end of the first conveyor; the second conveyor comprising a plurality of driven belts which travel over each of an upwardly inclined planar ramp segment, an arched transition segment, and a planar exit segment; the arched transition segment comprising either a belt slide or a plurality of serially arranged rollers.

24. The hopper loader of claim 23 wherein said slippage resistance means comprises an array of upright, spaced projections extending outwardly perpendicularly from the top surface of the belt.

25. The hopper loader of claim 24 wherein said projections comprise an array of upright, spaced ridges projecting outwardly from the top surface, said ridges being arranged in a plurality of parallel rows across the width and perpendicular to the length of the top surface.

26. The hopper loader of claim 25 wherein said spaced ridges comprise an elastomeric material.

27. The hopper loader of claim 25 wherein the ridges project from the top surface a distance of from about 1/32 inch to about 3/16 inch.

28. The hopper loader of claim 24 wherein said projections comprises a plurality of spaced teeth.

29. The hopper loader of claim 24 wherein said projections comprise an array of upright, spaced teeth projecting outwardly from the top surface, said teeth being arranged in a plurality of parallel rows across the width and perpendicular to the length of the top surface.

30. The hopper loader of claim 29 wherein said teeth comprise an elastomeric material.

31. The hopper loader of claim 29 wherein said teeth project from the top surface a distance of from about 1/32 inch to about 3/16 inch.

32. The hopper loader of claim 23 wherein said slippage resistance means comprises a fibrous material, a brush, velour fabric, or hook and loop fastener material.

33. A process for distributing a separated, shingled stream of the signatures from a parallelepiped shaped stack of vertically aligned signatures which comprises i) providing a hopper-loader which comprises:

a) a chassis;

b) a first continuous, downwardly inclined planar conveyor mounted on the chassis; said first conveyor being capable of moving a parallelepiped shaped stack of vertically aligned signatures to a second conveyor and depositing a separated, shingled stream of the signatures onto the second conveyor; said first conveyor comprising at least one continuous belt having a top surface and a bottom surface defined by a length and a width, said belt having slippage resistance means extending outwardly from the top surface of the belt which is capable of engaging bottom edges of the signatures and resisting the slippage of the bottom edges of the signature on the belt; and c) a single, continuous, second conveyor mounted on the chassis and aligned with an end of the first conveyor; the second conveyor comprising a plurality of driven belts which travel over each of an upwardly inclined planar ramp segment, an arched transition segment, and a planar exit segment; the arched transition segment comprising either a belt slide or a plurality of serially arranged rollers;

ii) placing a parallelepiped shaped stack of vertically aligned signatures onto the first conveyor; an edge of each signature being positioned within the slippage resistance means;

iii) moving the parallelepiped shaped stack of vertically aligned signatures with the first conveyor and depositing a separated, shingled stream of the signatures onto the second conveyor.

* * * * *